United States Patent [19]

Arimilli et al.

[11] 4,369,242

[45] Jan. 18, 1983

[54] NON-POROUS AND POROUS $AL_2O_3$ BARRIER ZONES IN LAYERED ELECTROPHOTOGRAPHIC DEVICE

[75] Inventors: Padmanabham A. Arimilli, Maplewood; Frank E. Aspen, St. Paul, both of Minn.

[73] Assignee: Minnesota Mining and Manufacturing Company, St. Paul, Minn.

[21] Appl. No.: 290,344

[22] Filed: Aug. 5, 1981

Related U.S. Application Data

[63] Continuation-in-part of Ser. No. 190,423, Sep. 25, 1980, abandoned.

[51] Int. Cl.[3] ..... G03G 5/14

[52] U.S. Cl. ..... 430/58; 430/526; 430/64

[58] Field of Search ..... 430/58, 526, 64

[56] References Cited

U.S. PATENT DOCUMENTS

| | | | |
|---|---|---|---|
| 2,901,348 | 8/1959 | Dessauer et al. | 480/65 |
| 3,816,840 | 6/1974 | Kotz | 430/58 X |
| 3,837,851 | 9/1974 | Shattuck et al. | 430/58 X |
| 3,928,034 | 12/1975 | Rogensburger | 430/58 |
| 4,025,339 | 5/1977 | Kuehnle | 430/58 X |

FOREIGN PATENT DOCUMENTS

| | | | |
|---|---|---|---|
| 1334671 | 7/1963 | France | 430/65 |

*Primary Examiner*—John D. Welsh

*Attorney, Agent, or Firm*—Cruzan Alexander; Donald M. Sell; Mark A. Litman

[57] ABSTRACT

The present invention relates to novel electrophotographic imaging systems and particularly to novel electrophotographic photoreceptors. These photoreceptors comprise a conductive substrate, an inorganic barrier-charge transport layer, and a photoconductive insulative layer. The barrier charge transport layer comprises aluminum oxide having a non-porous zone adjacent the substrate, and a porous charge transport zone.

13 Claims, 1 Drawing Figure

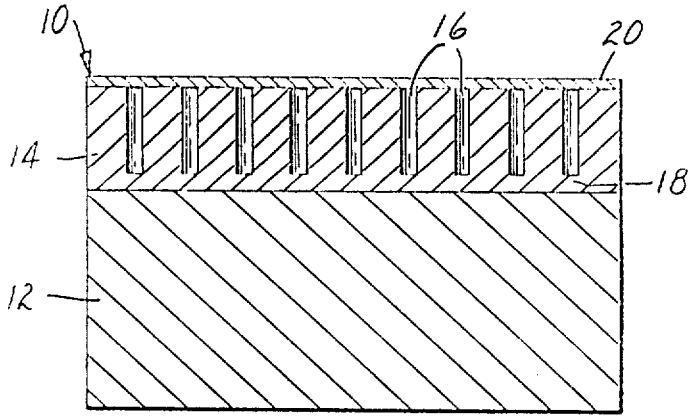
10
16
20
14
18
12

NON-POROUS AND POROUS $AL_2O_3$ BARRIER ZONES IN LAYERED ELECTROPHOTOGRAPHIC DEVICE

PRIORITY INFORMATION

This application is a continuation-in-part of U.S. Ser. No. 190,423 filed on Sept. 25, 1980, abandoned.

BACKGROUND OF THE INVENTION

In the art of electrophotography, and particularly xerography, it is well known to coat a conductive substrate, such as an electrically conductive aluminum drum or aluminized polymeric sheeting, with a photoconductive insulating layer to form a composite, layered, imaging article. The surface of the layered imaging structure is then uniformly electrostatically charged and exposed to a pattern of activating electromagnetic radiation, such as light. The charge is selectively dissipated in the illuminated areas of the photoconductive insulator, thus leaving an electrostatic charge image in the nonilluminated areas. The electrostatic charge image can then be developed by a number of means to form a visible image. If desired, the developed image may be fixed or made permanent on the photoconductive insulator surface. Alternatively, the developed image, in the form of electrostatically adhered toner powders or liquids, may be transferred to paper or some other material and subsequently affixed by some suitable means. This may be done, for example, by attracting fusible toner particles to the charged areas, then transferring and fusing the imagewise distributed particles to another surface.

The conductive substrate utilized in such electrophotographic systems usually comprises a metal such as brass, aluminum, gold, platinum, steel or the like and may be of any convenient thickness, rigid or flexible, and in the form of a sheet, web or cylinder. This substrate may also comprise such materials as metallized paper and plastic sheets, conductive polymers, or glass coated with a thin conductive coating. In all cases, it is usually preferred that the support member be strong enough to permit a certain amount of handling. In some instances, an interfacial blocking layer for at least one type of charge carrier is utilized between the base electrode and the photoconductive insulator.

Typical photoconductive insulating materials useful in electrophotography include: (1) inorganic crystalline photoconductors such as cadmium sulfide, cadmium sulfoselenide, cadmium selenide, zinc sulfide, zinc oxide, and mixtures thereof, (2) inorganic photoconductive glasses such as amorphous selenium, selenium alloys, and selenium-aresenic, and (3) organic photoconductors such as phthalocyanine pigments and polyvinyl carbazole with or without additive materials which extend its spectral sensitivity.

The surface potential is of the utmost importance in the development of an electrostatic charge image. For greatest development latitude, the contrast potential ($V_c$) resulting from different levels of exposure should be as large as possible. The contrast potential ($V_c$) can be expressed by the equation:

$$V_c = \Delta\sigma / C \qquad \text{I}$$

where $\Delta\sigma$ is the change in surface charge density upon exposure to imaging radiation and C is the capacitance per unit area of the photoreceptor.

One prior art method of decreasing C and hence increasing $V_c$ has been to simply increase the photoconductive insulator thickness. However, the low charge carrier mobility in photoconductive insulators used in electrophotographic devices somewhat limits the useful thickness one can employ to decrease C. If the thickness is increased too much, the system will not have a useful discharge speed. In systems where the thickness can be increased somewhat to decrease C, then the increased thickness requirement also restricts the physical characteristics, such as flexibility and adhesion of the photoconductor to the final plate, drum or belt. Thus, to improve potential contrast in such systems, an electrically active transport overlayer on the photoconductor has been used as, for example, in U.S. Pat. No. 3,928,034. For xerographic use, this construction requires that the overlayer be substantially transparent and non-absorbing in the particular imaging radiation wavelength region. In addition, even though the overlayer is substantially transparent, as increasingly thicker layers are required, adsorption and scattering due to included particles and partial crystallization become significant and have a detrimental effect upon the sensitivity of the device and the quality of the copies produced.

The xerographic apparatus disclosed in U.S. Pat. No. 3,684,368 shows the use of photoreceptor constructions which bear some similarities to the constructions of the present invention. The reference shows the use of anodic, porous aluminum oxide layers between the metal layer and photoconductive insulator layer in order to improve the adhesion therebetween. The photoconductive insulative layers tend to be thick to provide decreased capacitance, with the preferred thickness range being 10–15 micrometers. The porous aluminum oxide layer shown in Example 3 is believed to have a thickness of about 0.17 micrometers.

The xerographic photoreceptor shown in Example 3 of U.S. Pat. No. 2,901,348 discloses an aluminum substrate with a 100 Angstrom (approximately 0.01 micrometers) coating of aluminum oxide and a twenty micrometer coating of a vitreous selenium photoconductive insulator layer.

DESCRIPTION OF THE INVENTION

The present invention relates to a novel photoreceptor having good charge acceptance characteristics comprising a conductive substrate, a charge transport/barrier layer comprising a porous aluminum oxide at least 0.15 micrometers thick, and a photoconductive insulator layer of less than 1 micrometer in thickness.

The photoreceptor is a novel two-layered photoreceptor structure comprised of a thin layer of photoconductive insulator deposited on an adjacent, relatively thick, porous anodized aluminum barrier layer/charge transport layer to produce an improved electrophotographic device. It was surprisingly found that the relatively thick porous oxide layer sandwiched between the conductive substrate and the photoconductive insulator also performed as a charge transport layer. Moreover, it was found that surface electrical potential enhancement was achieved and that this was directly proportional to the porous charge transport oxide layer thickness. Because of this novel construction, a low cost electrophotographic device can be produced which has improved imaging contrast, a low background in the developed images, a high recycle rate, long life, and the capability of producing excellent copies.

DESCRIPTION OF THE FIGURE

FIG. 1—A sectional view of the electrophotographic device according to this invention.

DETAILED DESCRIPTION OF THE DRAWING

The novel two-layered photoreceptor structure to provide an improved electrophotographic device can best be understood by reference to the drawing in conjunction with the following discussion. The FIG. 1 illustrates a photoreceptor 10 according to this invention. Substrate 12 is an electrically conductive substrate which is capable of lending physical support to the structure shown. It may be comprised of a substantially thick metallic sheet, aluminum drum blanks, metal or conductive polymer coated sheets, conductive particle filled polymeric sheets, or the like or a composite metal coating on a sufficiently rigid dielectric substrate. The metal may be selected from such materials as aluminum, brass, steel, silver, or the like. If it is desired to discharge the device by flooding radiation from the substrate side, then it is understood that a combination of materials must be selected to render substrate 12 sufficiently transparent to the flooding radiation.

Layer 14 is a unique barrier layer/charge transport layer according to this invention which is produced by the anodization of aluminum. Layer 14 has pores 16 in the aluminum oxide layer. An added asset of layer 14 is the barrier layer 18 lying adjacent to the metal surface in which no pores exist. This barrier layer 18 performs as a blocking layer for both positive charges (holes) and negative charges (electrons).

Layer 20 is a photoconductive insulative film. Useful photoconductive insulative materials include: (1) inorganic crystalline photoconductors such as cadmium sulfide, cadmium sulfoselenide, cadmium selenide, zinc sulfide, zinc oxide, and mixtures thereof, (2) inorganic photoconductive glasses such as amorphous selenium alloys, and (3) organic photoconductors. It is preferable that the photoconductive insulative layer 20 be capable of blocking appropriate (i.e., negative or positive) charges at the free surface.

DETAILED DESCRIPTION OF THE INVENTION

The conductive substrate used in the practice of the present invention may, as is well known in the art, be any conductive substrate. It may comprise a metal layer, a metal coating on a substrate such as a polymeric resin, a conductive polymer, a coating of a conductive polymer on a non-conductive polymeric resin, or the like. The substrate may be rigid or flexible, transparent or opaque, and may be in the shape of a cylinder, a sheet, an endless belt, or various other designs.

The photoconductive insulator layer may be any photoconductive insulator layer as known in the art which is less than 2.0 and preferably less than 1.0 micrometers thick. The composition of the photoconductive insulator layer is not critical to the practice of the present invention and may be selected from amongst any of the known materials in the art such as (1) inorganic crystalline photoconductors such as cadmium sulfide, cadmium sulfoselenide, cadmium selenide, zinc sulfide, zinc oxide, and mixtures thereof, (2) inorganic photoconductive glasses such as amorphous selenium, selenium alloys, and selenium-arsenic (e.g., $Ar_2Se_3$), and (3) organic photoconductors such as phthalocyanine pigments and polyvinyl carbazole and its derivatives with or without additive materials which extend its spectral sensitivity. As long as the layer provides photoconductive and insulative properties, it may be as thin as it can be made. Usually it will not be thinner than 0.05 micrometers, preferably it is at least 0.10 micrometers, and more preferably 0.15 micrometers to 0.8 micrometers. The upper limit on thickness is necessary to achieve the charge contrast enhancement of the structure of the present invention.

The barrier-charge transport layer performs uniquely within the structure of the present invention. The two zones of this single layer performs as both a blocking or barrier layer for positive charges (holes) and as a charge transport layer when a negative charge (electrons) is photoactively released from the photoconductive charge generating layer. The layer is produced by the anodization of aluminum. Anodization in certain environments generates a porous aluminum oxide layer. This layer preferably may be from about 0.15 to 25 micrometers thick. The pore diameters and the center-to-center spacing between pores is not critical to the practice of the present invention and varies because of changes in processing conditions during anodization such as temperature, electrolyte concentration, etc. Pore diameters on the order of 0.007 to 0.040 micrometers and average center-to-center spacing of from 0.010 to 0.400 are common. It is preferred that the average pore diameters be between 0.008 and 0.030 micrometers and that the average center-to-center spacing be between 0.010 to 0.080 or between 0.020 and 0.060 micrometers. The most preferred ranges are 0.010 to 0.020 (and specifically 0.012) micrometers for the pore size and 0.025 to 0.040 (and specifically 0.033) micrometers for center-to-center spacing of the pores. The barrier layer portion of the aluminum oxide layer, the non-porous area between the conductive substrate and the pores is usually between 0.003 and 0.05 micrometers, and is preferably between 0.006 and 0.03 micrometers. Typical pore-forming electrolytes which are used to anodize aluminum are selected from 15% sulfuric acid, 2% oxalic acid, 4% phosphoric acid, and 3% chromic acid. One of the most complete discussions of the process of anodization and the effects of parameter changes in the process on the characteristics of the aluminum oxide is to be found in "Anodic Oxide Films on Aluminum", J. W. Diggle, T. C. Downie, and C. W. Goulding, Rutherford College of Technology, Newcastle upon Tyne, England, a paper received July 29, 1968, which paper is incorporated herein by reference for its teaching of the anodization process and the properties of the films.

The structure of the present invention operates by first receiving an induced charge on the photoconductive insulator surface. The sensitized device is then imaged with imaging radiation. Light is absorbed by the photoconductive layer, creating electron-hole pairs. The holes and electrons are separated under the applied electric field. The electrons are injected into and transported through barrier layer/charge transport layer and the holes are transported to the surface of photoconductive insulative layer, thereby imagewise discharging the device where light strikes in proportion to the integrated amount of light which is absorbed. In the regions where radiation does not impinge upon the device, the charge distribution remains substantially the same as before the imaging step. The imaging step is now complete and the electrostatic latent charge image has been formed.

The electrostatic charge is then developed with toner to form a toner image on the electrophotographic drum. Excellent copy quality results when copies are made by transferring the toner image and subsequent toner images to plain paper. Added permanence is introduced in the transferred toner image if it is heat-fused or pressure-fused to the paper. The photoconductive insulator surface is then easily discharged and cleaned by conventional means. As previously mentioned, if it is desired to discharge by radiation from the underside, then substrate must be sufficiently transparent to the flooding radiation.

Having described in general the embodiment of this invention for electrophotography, some specific examples will now be given.

EXAMPLE 1

The photoconductive insulative layer consisted of 0.5 μm sputter deposited cadmium sulfide (CdS) on commercially available Alzak ® aluminum (Type 1) which has porous aluminum oxide on one face thereof. A 5 cm by 5 cm substrate was prepared by removing the protective adhesive-backed paper layer and cleaning the exposed aluminum oxide surface by immersing it in successive ultrasonic baths of acetone, trichloroethylene (bath 1) and trichloroethylene (bath 2), followed by rinses of trichloroethylene, methanol and acetone. The substrate was then blow dried in a stream of $N_2$ gas. The aluminum oxide layer on the commercially available Alzak ® aluminum was about 5 μm thick. The substrate was then placed into a Randex ® RF sputter deposition vacuum system and coated with about 0.5 μm of sputter-deposited CdS in the following manner.

The substrate was placed on a 6.3 cm by 8.8 cm aluminum heater block containing a resistive heating element and a calibrated resistive temperature sensitive element. The heater block was separated from the water-cooled J-arm anode platform of a Randex ® sputter module by a 5 cm by 5 cm by 1 mm thick piece of quartz. The heater block, quartz and anode table were thermally linked by applying a thin layer of high-vacuum silicone grease to each element. Also, the substrate was joined to the heater block with silicone grease to ensure that the temperature of the substrate was nearly the same as that measured at the heater block. The distance from the substrate to the hot pressed CdS target was about 5 cm.

The heater block was heated to 150° C. and the temperature was held constant to within 5° C. throughout the deposition. A premixed gas consisting of 6% $H_2S$ and 94% Ar was admitted to the vacuum chamber at a rate of 20 std ml/min. The pumping speed was adjusted by use of a throttle valve located between the vacuum chamber and the diffusion pump until the pressure in the vacuum chamber was stabilized at 2.5 mT.

The non-functional properties of the novel photoreceptor produced according to this invention were then measured. The surface was charged negatively by passing a single corona wire across the surface several times at a distance of about 1 cm. The surface voltage was measured with a Monroe electrostatic voltmeter using a transparent probe and recorded on a chart recorder. The photoreceptor described above could be charged to 220 volts. The time required to discharge in the dark to one-half that value (110 volts) was two minutes. When exposed to monochromatic light of 480 nm, 14 ergs/cm$^2$ were required to discharge the surface from 220 V to 110 V.

EXAMPLE 2

An anodization cell was fabricated from PVC plastic to accommodate 15 cm by 8 cm substrates and yielded substrates which were uniformly anodized over a 12.5 cm by 7.5 cm area. The cell was fabricated with three slots at each end which held the anode (aluminum substrate) and two cathodes fixed. The cathodes were 2.5 cm on either side of the anode. The electrolyte consisted of 15% concentrated $H_2SO_4$ and 85% deionized distilled water. The electrolyte was continuously circulated through about 6 meters of ¼ inch plastic tubing which was immersed in a water bath for the purpose of cooling the electrolyte. Current was passed from the anode to both cathodes at a fixed rate which was recorded along with the voltage between the cathodes and the anode, the time span of the anodization, and the temperature of the electrolyte. The anodization parameters for this example were:

| | |
|---|---|
| Substrate | 75μ thick aluminum foil which was 99.99% pure (i.e., 1199 aluminum foil) |
| Current | 2.5 amps |
| Voltage | 11.5 volts |
| Temperature | 19° C. |
| Time | 4.2 minutes |

The thickness of the anodized layer is known to be proportional to the product of the current and time for a given substrate material and electrolyte temperature. Typically, 32 amp-min/ft$^2$ will yield 1 μm of oxide thickness. Since both sides of the substrate are anodized, both sides are counted in the area.

In this Example, therefore, about a 1.5 μm thick oxide film was produced. Upon removal from the electrolyte, the substrate was immediately rinsed in running tap water followed by a rinse in deionized distilled water and in isopropyl alcohol and blown dry with $N_2$ gas.

A 5 cm by 5 cm piece was cut from this substrate and placed in the Model 3140 Randex ® RF sputter deposition unit of Example 1. A layer about 0.5 μm thick of CdS was then deposited onto this substrate with the following parameters:

| | |
|---|---|
| RF power | 300 W |
| Gas pressure | 2.5 mT |
| Gas flow | 20 std ml/min |
| Gas composition | 6% $H_2S$, 94% Ar |
| Substrate temp. | 132° C. |
| Deposition time | 8 minutes |

The resulting photoreceptor could be charged to −250 V. More than two minutes were required to discharge the surface voltage to −125 V in the dark. A miximum of 125 V contrast between exposed and unexposed regions was observed. A three second exposure to room light (about 30 ergs/cm$^2$) was required to obtain half of this contrast.

EXAMPLE 3

A barrier layer/charge transport layer about 5 μm thick was prepared on 1199 aluminum as in Example 2. A photoconductive insulator layer consisting of about 0.24 μm thick cadmium sulfide was deposited on layer 18 as in Example 2, however, the sputtering gas composition was pure argon.

The resulting photoreceptor could be charged to −240 V, the dark decay to −120 V required about 12 seconds, and a voltage contrast of 40 volts was observed. Again, a three second exposure to room lights (~30 ergs/cm$^2$) was required to obtain half of this contrast.

EXAMPLE 4

Using resistive heating techniques, a 0.25 μm thick photoconductive insulative layer comprised of a 94% Se, 6% Te alloy, was vacuum deposited on the commercially available Alzak® substrate prepared as in Example 1. However, one-half of the aluminum oxide barrier layer/charge transport layer was chemically stripped from the substrate prior to the deposition of the photoconductive insulative SeTe layer. The resulting photoreceptor could be charged to −140 V where layer remained, but to only −20 V where the layer was stripped off. The voltage contrast and exposure to one-half contrast were similarly effected by the presence of the layer, i.e., −80 V to −20 V and 70 ergs/cm$^2$ to 20 ergs/cm$^2$, respectively.

To demonstrate that the barrier layer/charge transport layer of this invention produces no advantage and, in fact, is undesirable, for thicker photoconductive insulative layers, a layer 40 μm thick of 94% Se, 6% Te alloy was deposited as above on the stripped and unstripped commercial Alzak® substrates. When charged negatively, the voltage acceptance was increased from −425 for the stripped portion to −780 V for the anodized portion, however the voltage contrast was decreased from 60 V to zero. When charged positively, the voltage acceptance was reduced slightly from 560 V to 460 V and the voltage contrast was reduced from 560 V for the stripped portion to 380 V for the anodized portion.

EXAMPLE 5

1 μm of $As_2Se_3$ was deposited using resistive heating techniques onto a commercially available Alzak® substrate, half of which was stripped of the oxide layer. The voltage acceptance was +113 V when charged positively, and −120 V when charged negatively for the anodized portion and +18 V, −27 for the stripped portion. The corresponding voltage contrast upon exposure was also increased for the anodized portion to +35, −20 from +18, −15 volts when respectively charged positively and negatively.

In contrast to this when a thick layer (15 μm) of $Ar_2Se_3$ was deposited onto a similar substrate the voltage contrast was reduced to +12, −0 volts for the anodized portion from +75, −8 volts for the stripped portion even though voltage acceptance was increased to +305, −365 from +75, −115 volts. This example shows that the voltage contrast is enhanced by the anodized aluminum barrier-charge transport layer of the present invention when used with relatively thin photoconductive insulator layers. Conversely, it is surprising that the voltage contrast is not enhanced and is in fact reduced with relatively thick (i.e., >5 micrometers) photoconductive insulator layers.

EXAMPLE 6

A photoreceptor was prepared by coating a 1 μm thick coating of Perylene Red onto the aluminum oxide coated substrate of Example 1. This resulted in a 1.5 μm thick anodized aluminum substrate which was compared to a similar coating on stripped aluminum. The resulting photoreceptor could be charged to −171 V compared to −72 V on stripped aluminum. The voltage contrast compared 167 V to 72 V.

EXAMPLE 7

A barrier layer/charge transport layer about 2 μm thick was prepared on 1100 aluminum as in Example 2 using 4% phosphoric acid as the electrolyte. The anodizing conditions were:

| | |
|---|---|
| Substrate | 100 μm thick aluminum foil which was 99% pure (i.e., 1100 Al Foil) |
| Current | 0.7 amps |
| Voltage | 100 volts |
| Temperature | 22° C. |
| Time | 18 minutes |

The resulting oxide layer was similar to that in Example 2 except that the pore diameter was approximately 0.03 μm and the center-to-center spacing was approximately 0.28 μm.

The resulting photoreceptor could be charged to −230 volts, the dark decay to −115 volts was greater than two minutes, and a voltage contrast of 127 volts was observed. An exposure of 47 ergs/cm$^2$ was required to obtain half of this contrast.

What is claimed is:

1. An electrophotographic device comprising:
(1) an electrically conductive substrate,
(2) a barrier-charge transport layer comprising aluminum oxide, wherein said layer comprises a non-porous barrier zone adjacent said substrate and a porous charge transport zone, and
(3) a photoconductive insulator layer of less than two micrometers adjacent the porous charge transport zone of said barrier-charge transport layer.

2. The device of claim 1 wherein the barrier-charge transport layer is at least 0.15 micrometers thick, the pore diameters of the porous zone are between 0.007 and 0.040 micrometers, the center-to-center spacing of the pores is from 0.010 to 0.400 micrometers, and the photoconductive insulator layer is less than 1.0 micrometers thick.

3. The device of claim 2 wherein said non-porous zone is between 0.003 and 0.05 micrometers thick.

4. The device of claim 1 wherein said photoconductive insulator layer is selected from the class consisting of inorganic crystalline photoconductors, inorganic photoconductive glasses, and organic photoconductors and the pore diameters of the porous zone are between 0.007 and 0.040 micrometers, and the average center-to-center spacing of the pores is from 0.010 to 0.080 micrometers.

5. The device of claim 3 wherein said photoconductive insulator layer is selected from the class consisting of inorganic crystalline photoconductors, inorganic photoconductive glasses, and organic photoconductors.

6. The device of claim 5 wherein said photoconductive insulator layer is at least 0.05 micrometers and less than 1.0 micrometers in thickness.

7. The device of claim 1 wherein said photoconductive insulator layer is at least 0.10 micrometers and less than 1.0 micrometers in thickness.

8. The device of claim 6 wherein said photoconductive insulator layer comprises cadmium sulfide, cadmium sulfoselenide, cadmium selenide or mixtures thereof.

9. The device of claim 7 wherein said photoconductive insulator layer comprises cadmium sulfide, cadmium sulfoselenide, cadmium selenide, or mixtures thereof.

10. The device of claim 6 wherein said substrate is selected from the group consisting of metal, metal coated polymeric resin, conductive polymeric resin, conductive polymeric resin coated onto a polymeric resin, conductive particle filled polymeric resin, and mixtures thereof.

11. The device of claim 1 wherein said photoconductive insulator layer is between 0.10 and 1.0 micrometers in thickness and comprises a photoconductor selected from the class consisting of inorganic crystalline photoconductors, inorganic photoconductive glasses and organic photoconductors, and wherein said barrier-charge transport layer is between 0.15 and 25 micrometers, the barrier zone of said barrier-charge transport layer is between 0.006 and 0.03 micrometers, the pore diameters of said porous zone are between 0.008 and 0.030 micrometers and the center-to-center spacing of said pores is between 0.020 and 0.060 micrometers.

12. An electrophotographic device comprising:

(1) an electrically conductive substrate, (2) a barrier-charge transport layer comprising aluminum oxide, wherein said layer comprises a non-porous barrier zone adjacent said substrate and a porous charge transport zone, and (3) a photoconductive insulator layer of less than two micrometers adjacent the porous charge transport zone of said barrier-charge transport layer wherein the barrier-charge transport layer is at least 0.15 micrometers thick, the pore diameters of the porous zone are between 0.007 and 0.040 micrometers, the center-to-center spacing of the pores is from 0.010 to 0.400 micrometer, and the photoconductive insulator layer is less than 2.0 micrometers thick.

13. The device of claim 12 wherein said photoconductive insulator layer is between 0.10 and 1.0 micrometers in thickness and comprises a photoconductor selected from the class consisting of inorganic crystalline photoconductors, inorganic photoconductive glasses and organic photoconductors, and wherein said barrier-charge transport layer is between 0.15 and 25 micrometers, the barrier zone of said barrier-charge transport layer is between 0.006 and 0.03 micrometers, the pore diameters of said porous zone are between 0.008 and 0.030 micrometers, and the center-to-center spacing of said pores is between 0.020 and 0.060 micrometers.

* * * * *